US005225009A

United States Patent [19]

Orikasa et al.

[11] Patent Number: 5,225,009

[45] Date of Patent: Jul. 6, 1993

[54] PROCEDURE FOR MANUFACTURING CUTTING MATERIAL OF SUPERIOR TOUGHNESS

[75] Inventors: Yousuke Orikasa; Masahiro Yokomizo; Sadao Shimizu; Yukio Kawaoka, all of Omiya; Kenji Kaneko, Okegawa; Hiro Ohzeki, Omiya, all of Japan

[73] Assignee: Mitsubishi Materials Corporation, Tokyo, Japan

[21] Appl. No.: 834,809

[22] Filed: Feb. 13, 1992

[30] Foreign Application Priority Data

Feb. 18, 1991 [JP] Japan ..... 3-045889

[51] Int. Cl.[5] ..... C22F 1/10

[52] U.S. Cl. ..... 148/677; 148/410

[58] Field of Search ..... 148/677, 410

[56] References Cited

U.S. PATENT DOCUMENTS 4,245,698 1/1981 Berkowitz et al. ..... 148/677

4,279,645 7/1981 Brown .

FOREIGN PATENT DOCUMENTS 2084188 4/1982 Great Britain .

59-25941 2/1984 Japan .

OTHER PUBLICATIONS

Metals Handbook, 9 ed., American Society for Metals, Vol. 3, Properties and Selection Stainless Steels, Tool Materials and Special-Purpose Metals, 1983, pp. 154–155.

*Primary Examiner*—R. Dean

*Assistant Examiner*—Margery S. Phipps

*Attorney, Agent, or Firm*—Cushman, Darby & Cushman

[57] ABSTRACT

The object of the present invention is to provide a method for the manufacturing of a cutting material possessing excellent toughness and a high strength. The composition by weight of the Nickel alloy ingot, is chromium (Cr )14–23%, molybdenum (Mo) 14–20%, tungsten (W) 0.2–5%, iron (Fe) 0.2–7%, cobalt (Co) 0.2–2.5% with the remaining portion being made up of Ni and unavoidable impurities. After undergoing a solution heat treatment process, the Ni ingot undergoes plastic working, at a product ratio above 80%, followed by heating at a temperature of 500°–600° C. for longer than 30 minutes. Heating the alloy of the aforementioned composition at the above mentioned temperature promotes the precipitation of an intermetallic compound possessing a hardness greater than 57 on the HRC. The resulting superior cutting material is resistant to corrosion even when exposed to sea water. The cutting material obtained through the process of the present invention provides a high resistance to both rust and chipping in addition to a high abrasion resistance, all of which are advantages over the conventional stainless steel cutting material.

1 Claim, No Drawings

PROCEDURE FOR MANUFACTURING CUTTING MATERIAL OF SUPERIOR TOUGHNESS

BACKGROUND OF THE INVENTION

1. Field of the Invention

The present invention relates to a procedure for manufacturing a cutting material comprised of a precipitation-hardened intermetallic compound of nickel alloy possessing superior strength, hardness and a long life span.

2. Prior Art

Generally up until now, many different kinds of cutting machines have been employed for such things as forming wafers, through the cutting of silicon monocrystal ingots such as those used in semiconductor devices, to the slicing of meat. Such materials as carbon steel and stainless steel are generally the cutting materials used in these applications.

However recently, accompanying the high speed and high performance cutting machines, is a tendency to increase the severity of the usage conditions. Due to insufficiencies in the strength and hardness of the cutting materials used in the aforementioned prior art, there is a problem in the reduction of labor in that the cutting materials must be exchanged frequently because of their relatively short life span. Moreover, nickel alloy is known to possess heat resistance and a high toughness in addition to being anti-corrosive, but due to the low hardness of this type of alloy, it could not be applied for use where high hardness was required.

SUMMARY OF THE INVENTION

Based on the results of the above mentioned research, the object of the present invention is to provide a cutting material having high strength and hardness as well as superior toughness.

In the procedure for manufacturing a cutting material of excellent toughness disclosed in the present invention, the composition by weight of the Nickel alloy ingot, excluding unavoidable impurities, is chromium (Cr )14–23%, molybdenum (Mo) 14–20%, tungsten (W) 0.2–5%, iron (Fe) 0.2–7%, cobalt (Co) 0.2–2.5% with the remaining portion being Nickel. Under conventional conditions, the Nickel ingot undergoes hot forging and hot rolling to form a heat-stretched material. The heat-stretched material obtained is then, under conventional conditions, given a solution heat treatment at a temperature of 1100° C.–1200° C. producing an austenite organization. Next, this austenite organization undergoes cold working, followed by plastic working at a product ratio above 80%. When this plastic worked material is heated, a fine intermetallic compound of Ni-Mo can be precipitated out in the substrate. If this mixture is allowed to be aged, the precipitation of the aforementioned intermetallic compound can be remarkably promoted. In this case, a hardness over 57 on the Rockwell hardness C scale is possible, and a high strength can be exhibited.

Through the procedure of the present invention, a durable, superior cutting material possessing high strength and hardness can be manufactured. This manufactured cutting material, uniformly dispersed as a fine Ni-Mo intermetallic compound in the substrate, exhibits a hardness over 57 on the Rockwell hardness C scale in addition to having a high strength. Consequently, when the cutting material obtained through the present invention is applied in any kind of cutting machine, a long lasting usage is displayed thus the time and labor involved in the changing of the cutting material can be avoided. In addition to its use in the elimination of labor, this cutting material is also able to sufficiently accommodate the high speed and high performance cutting machines. When the cutting material obtained through the procedure of the present invention is used in paper knives, meat cutters, pointed knives, scrapers and such, the cutting material lasts a remarkably long time and demonstrates such qualities as superb slicing. Besides the industrial uses, the cutting material produced by the present invention also demonstrates a number of other advantageous characteristics.

DETAILED DESCRIPTION OF THE PREFERRED EMBODIMENTS

In the procedure for manufacturing a durable, superior cutting material disclosed in the present invention, after a solution heat treatment is performed on the heat-stretched material of Ni alloy having the composition by weight of, Cr 14–23%, Mo 14–20%, W 0.2–5%, Fe 0.2–7%, Co 0.2–2.5% with the remainder Ni, excluding unavoidable impurities, cold working is carried out followed by plastic working at a product ratio above 80%. Finally, the material is heated for 30 minutes or more at a temperature between 500°–600° C.

In the following, the ranges of the components in the aforementioned composition as well as limitations in the manufacturing conditions will be explained.

A. Component Composition

(a) Chromium

In the Cr component, the austenite passive ability is greatly improved; anti-corrosive property is also improved, but if the percent weight of the Cr is less than 14%, resistance to corrosion deteriorates considerably due to the atmospheric oxidizing effects. However, if the percent weight exceeds 23% the austenite organization becomes unstable, and the stable formation of the fine Ni-Mo intermetallic compound that precipitates out into the austenite substrate becomes impossible. Thus factoring in the lowering of the anti-corrosiveness, the percent weight of Cr has been restricted to 14–23%.

(b) Molybdenum

The Mo component is combined with Ni, and forms an Ni-Mo intermetallic compound which is dispersed uniformly in the substrate as a precipitate. In this manner, strength is improved, but when the percent weight is less than 14%, the desired aforementioned usage cannot be obtained; on the other hand, if the percent weight exceeds 20%, the hot and cold rolling abilities are decreased, thus the percent weight of Mo has been restricted to 14–20%.

(c) Tungsten

The W component hardens the austenite substrate thus strength is improved, because the W can be incorporated into the austenite lattice. However, when the percent weight is less than 0.2% the desired strength improvement cannot be obtained; on the other hand, if the percent weight exceeds 5%, both hot and cold rolling abilities are decreased, therefore the percent weight of W has been restricted to 0.2–5%.

(d) Iron

In the Fe component, both the hot and cold rolling abilities are improved, but when the percent weight of Fe falls below 0.2%, the aforementioned desired result is unobtainable. On the other hand, when the percent weight exceeds 7%, strength is reduced, thus the percent weight of Fe has been restricted to 0.2–7%.

(e) Cobalt

The Co component also can be soluble in the austenite organization as a solid state, in addition to stabilizing it. Stable precipitate of the intermetallic compound can be obtained as a result of the precipitation procedure, but when the percent weight is less than 0.2%, the aforementioned result is unobtainable; however, even when the percent weight exceeds 2.5%, improvement over the aforementioned application is not possible, thus giving careful consideration to economic factors, the range of Co has been restricted to 0.2–2.5%.

B. Manufacturing conditions (a) Cold rolling ratio

When the cold-rolling ratio is less than 80%, following the cold-rolling process, during the precipitation hardening, sufficient precipitate of the intermetallic compound is unobtainable. In this case, obtaining a hardness of above 57 on the HRC becomes impossible, thus the cold rolling ratio is required to be greater than 80%. Furthermore, in carrying out this cold working, each pass of the cold rolling machine amounts to 3–4% of the draft, thus the cold-rolling is continued until the total draft (working ratio) is greater than 80%, at which point a thin sheet of the Ni alloy can be obtained. As a result of this work hardening, the hardness of the thin sheet obtained from these aforementioned steps will be greater than 50 on the HRC: here, a working ratio of greater than 95% percent is more preferable. In the manufacturing of the aforementioned Ni alloy composition at a working ratio of greater than 95%, the process is executed using an extremely hard alloy roll. In this manner, when manufacturing at a working ratio greater than 95%, a cutting material possessing a hardness greater than 60 on the HRC can be obtained using a precipitation hardening processes which will be described hereafter.

(b) Precipitation hardening procedure

When the previously mentioned thin sheet is heated at a temperature of 500°–600° C. for longer than 30 minutes, a hardness greater than 57 on the HRC is achieved for the resulting intermetallic precipitate. In this case, if the temperature is below 500° C., the precipitation of the intermetallic compound requires a large amount of time and the manufacturing ability becomes undesirable. On the other hand, if the temperature exceeds 600° C. the solid dissoloved proportion of the alloy component in the austenite substrate becomes large, and the precipitation of the intermetallic compound cannot be sufficiently carried out. Consequently, a hardness of greater than 57 on the HRC is becomes unobtainable, thus the temperature at which the thin sheet can be heated has been restricted to 500°–600° C.

When this thin sheet is worked into a form satisfying the usage conditions, a Ni alloy possessing a high hardness, in addition to a uniquely high anti-corrosiveness, heat resistance and abrasion resistance is obtainable.

As described above, the cutting material obtained through the procedure of the present invention has a high anti-corrosiveness, and will not rust even when exposed to sea water. Extremely advantageous is the fact that due to the high toughness possessed by this cutting material, it will not chip or snap during usage. Thus, the cutting material obtained through the present invention would be most suitable for use as a diver's knife. As well, due to the aforementioned superior anti-corrosiveness of the cutting material obtained through the present invention, there is no fear of abrasive corrosion even when used for cutting Japanese pickled vegetables or foods pickled in salt. Besides the fact that when used the cutting material, due to its high toughness, is difficult to chip, even though its hardness is at the level used by professional chefs, the cutting material can be sharpened by any normal household whet stone. The cutting material obtained through the process of the present invention provides a high resistance to both rust and chipping in addition to a high abrasion resistance, all of which are advantages over the conventional stainless steel knife. Additionally this cutting material can be applied for use in conventional tonsorial scissors. Furthermore, due to the high heat resistance, anticorrosiveness, and spring-like effect possessed by the cutting material obtained through the present invention, it is also most suitable for used in extreme conditions as in acid or alkali environments.

The cutting material manufacturing process of the present invention will now be described more concretely by the following example.

EXAMPLES

Using a high frequency induction furnace, the molten metal, comprising the component composition shown in Table 1, is manufactured into an ingot possessing a diameter of 150 mm and a length of 400 mm. This ingot is casted and then undergoes a hot forging process at a starting temperature of 1200° C. and a plate having a thickness of 50 mm is obtained. This plate is then put through a hot rolling process at a starting temperature of 1200° C. to obtain a heat stretched material with a thickness of 20 mm. After the heat stretched material is put through a solution heat treatment process in which a temperature of 1150° C. is maintained for 2 hours, the product undergoes cold working at the rolling ratios shown in Table 1. Through a precipitation hardening process performed under the conditions displayed in Table 1, comparison methods 1–4 and procedures 1–11 of the present invention are all carried out, and cutting materials were manufactured.

The tensile strength and hardness (HRC) were then measured for each of the cutting materials obtained and the results were recorded in Table 1. As well, for comparative purposes, characteristics of a stainless steel cutting material of thickness 4 mm and the structural steel product obtained through conventional methods 1 and 2 have been gathered together and are also stated in Table 1.

TABLE 1

| Present Invention | Component Composition of the Ni alloy (percent weight) | | | | | | cold rolling ratio (%) | precipitation hardening process | | Cutting Material Charac. | |
|---|---|---|---|---|---|---|---|---|---|---|---|
| | Cr | Mo | W | Fe | Co | Ni + impurities | | Temp (°C.) | Holding Time (hr) | HRC Hardness | T.S. *1 |
| 1 | 14.2 | 16.4 | 3.80 | 5.06 | 0.94 | 59.6 | 95 | 550 | 100 | 63 | 221 |
| 2 | 18.4 | 16.5 | 3.76 | 5.13 | 1.01 | 55.2 | 95 | 550 | 70 | 61 | 215 |
| 3 | 22.7 | 16.3 | 3.74 | 5.07 | 0.99 | 51.2 | 95 | 550 | 50 | 60 | 210 |
| 4 | 18.5 | 14.3 | 3.76 | 5.11 | 0.98 | 57.35 | 90 | 550 | 100 | 58 | 207 |
| 5 | 18.6 | 19.8 | 3.79 | 5.09 | 1.04 | 51.68 | 85 | 550 | 100 | 56 | 202 |
| 6 | 18.3 | 16.5 | 0.23 | 5.04 | 0.94 | 58.99 | 90 | 550 | 50 | 57 | 202 |
| 7 | 18.7 | 16.2 | 4.91 | 5.08 | 0.96 | 54.15 | 85 | 550 | 100 | 58 | 205 |
| 8 | 18.5 | 16.4 | 3.72 | 0.24 | 0.99 | 60.15 | 90 | 550 | 100 | 57 | 205 |
| 9 | 18.4 | 16.3 | 3.76 | 6.95 | 0.97 | 53.62 | 95 | 575 | 100 | 61 | 210 |
| 10 | 18.6 | 16.4 | 3.74 | 5.21 | 0.22 | 55.83 | 95 | 525 | 100 | 60 | 210 |
| 11 | 18.6 | 16.2 | 3.69 | 5.23 | 2.46 | 53.82 | 90 | 550 | 100 | 60 | 208 |
| Comparison Methods | | | | | | | | | | | |
| 1 | 18.5 | 16.3 | 3.70 | 5.20 | 0.97 | 55.33 | 70 | 550 | 100 | 53 | 192 |
| 2 | 18.5 | 16.3 | 3.70 | 5.20 | 0.97 | 55.33 | 95 | 450 | 100 | 50 | 190 |
| 3 | 18.5 | 16.3 | 3.70 | 5.20 | 0.97 | 55.33 | 95 | 800 | 100 | 48 | 185 |
| 4 | 18.5 | 16.3 | 3.70 | 5.20 | 0.97 | 55.33 | 95 | 550 | 0.3 | 50 | 191 |
| Conventional Methods | | | | | | | | | | | |
| 1 | Steel Structural Organization (C: 0.20%, Si: 0.25%, Mn: 0.7%, P: 0.020%, S: 0.028%, Cr: 1.02%, Mo: 0.20%, Fe: Remainder) | | | | | | | Temperatures Hardening: 925° C. Tempering: —°C. | | 48 | 170 |
| 2 | Stainless Steel (C: 0.70%, Si: 0.82%, Mn: 0.72%, P: 0.03%, S: 0.02%, Cr: 17.0%, Fe: Remainder) | | | | | | | Temperatures Hardening: 1000° C. Tempering: 300° C. | | 40 | 128 |

*1 T. S. = Tensile Strength, kg/mm$^2$

From the results displayed in Table 1, it is apparent that all of the cutting materials manufactured by the procedures 1–11 of the present invention possess an extremely high hardness and strength as well as a relatively long life span when compared with that obtained through conventional methods 1 and 2. As shown in comparison methods 1–4, when one of the parameters is outside of the range of the manufacturing conditions of the present invention, sufficient precipitate of the intermetallic compound becomes unobtainable, thus a cutting material possessing low hardness is all that can be obtained.

What is claimed is:

1. A process for manufacturing a cutting material of excellent toughness from a nickel alloy represented by a following composition;

Cr: 14–23% by weight
Mo: 14–20% by weight
W: 0.2–5% by weight
Fe: 0.2–7% by weight
Co: 0.2–2.5% by weight
Ni: remaining portion, and unavoidable impurities, the process comprising the steps of;

(a) preparing a Ni alloy of the above-represented composition,
(b) hot rolling the prepared Ni alloy,
(c) solution heat treating the hot rolled Ni alloy,
(d) cold plastic working the solution heat treated Ni alloy at a working ratio greater than 80%,
(e) heating the cold plastic worked Ni alloy at a temperature of 500°–600° C. for longer than 30 minutes.

* * * * *